US005117560A

United States Patent [19]

Nevins

[11] Patent Number: 5,117,560

[45] Date of Patent: Jun. 2, 1992

[54] FULL CIRCLE PROTRACTOR WITH DETACHABLE ADJUSTABLE LEG ASSEMBLY FOR MEASURING ANGLES

[76] Inventor: Mary Nevins, 9142 S. Sproat St., Oak Lawn, Ill. 60453

[21] Appl. No.: 534,113

[22] Filed: Jun. 6, 1990

[51] Int. Cl.[5] ..... B43L 7/10

[52] U.S. Cl. ..... 33/471; 33/424

[58] Field of Search ..... 33/471, 424, 534, 425, 33/426, 465

[56] References Cited

U.S. PATENT DOCUMENTS

| | | | |
|---|---|---|---|
| 346,519 | 8/1886 | Tybjerg | 33/471 |
| 552,261 | 12/1895 | Rafferty | 33/471 |
| 655,005 | 7/1900 | Penfield | 33/471 |
| 1,128,673 | 2/1915 | Foner | 33/471 |
| 1,277,860 | 9/1918 | Civitts | 33/471 |
| 1,524,730 | 2/1925 | Cain | 33/471 |
| 1,665,898 | 4/1928 | Strickland | 33/471 |
| 1,878,119 | 9/1932 | Dowd | 33/471 |
| 2,278,440 | 4/1942 | Graves | 33/471 |
| 2,594,574 | 4/1952 | Marosen | 33/471 |

FOREIGN PATENT DOCUMENTS

| | | | |
|---|---|---|---|
| 2595813 | 9/1987 | France | 33/424 |
| 136982 | 12/1919 | United Kingdom | 33/424 |

*Primary Examiner*—Thomas B. Will

[57] ABSTRACT

A measuring instrument includes a pair of pivotally connected legs that can be placed on a circular protractor. The protractor contains three separate scales one of which will translate angular measurement provided by the pair of adjustable legs directly into a reading for setting the angle of a saw blade in an adjustable miter saw.

5 Claims, 3 Drawing Sheets

FULL CIRCLE PROTRACTOR WITH DETACHABLE ADJUSTABLE LEG ASSEMBLY FOR MEASURING ANGLES

BACKGROUND OF THE INVENTION

Field of the Invention

This invention has to do with a measuring tool for use in the construction profession with particular applicability to finish carpentry, piping layouts, floor and ceiling installations and cabinetry. It also has direct applications in the graphic arts field, the engineering and drafting fields and other manufacturing situations where angle measurements are performed.

More specifically, this invention is, in a common embodiment, a hand held scale that allows for measurement of both inside and outside acute and obtuse angles. Three degreed scales allow the user to simultaneously determine;

1) the whole angle measured
2) the bisected or miter angle
3) the miter angle setting to be used on a miter saw.

In the fitting of trim and decorative pieces to the surface of wall surfaces which meet at angular junctions it has been found that there is no effective way of translating the angle of the wall juncture to a miter saw for cutting the trim. The most common method for matching trim angles following a corner is to use a device that is laid on the angle and is locked in that position. The device, sometimes called a "carpenter's square", is then laid on the piece of trim to be mitered and a line for the proposed cut is scribed on the piece. The craftsman then takes the piece to his miter saw and sets the saw by "eyeballing" the blade over the scribed line to get the proper cut. In more precise situations the angle setting of the carpenter's square can be transferred to a protractor and that angle reading is then set into the miter saw using a scale provided on the miter saw.

In the first instance above the "eyeballing" of the saw miter angle can be accurate if the craftsman is very experienced and has learned, through trial an error (including many "miscuts" or poor "fitups") the necessary position of his saw blade relative to his scribed work. However, the usual situation is that such cuts are often inaccurate, especially when made by anyone less than expect craftsmen whose work entails installing trim pieces routinely. The second method above is accurate but requires an extra step, that of transferrings the "square" setting to the protractor.

The invention provided herein gives a person working with wall trim, such as chair rail, cove molding, base board and other joinery as well as with non-decorative trim installations such as plumbing, electrical conduit, floor and carpet installations, aerospace applications and other situations where angles have to be taken from a surface or an edge and measured for a subsequent operation, a scale that reads not only the whole angle measured and the bisected or miter angle but also the miter angle setting for use on a miter saw having an angle scale incorporated thereon.

SUMMARY OF THE INVENTION

A scale is provided that has a full circle disc with a plurality of scale measurements scribed thereon. The full circle disc wheel also has a central portion that, at the center of the disc wheel, is provided with a recess or aperture. Mountable to the full circle scale is an adjustable leg assembly of two legs which extend beyond the perimeter of the degree disc. The legs are each provided with a means to allow the user to read data from the scale measurements scribed on the disc. A wing nut means, in cooperation with a center pivot point for the adjustable legs, allows the user to adjust tension of the assembly to firmly hold a setting. The center pivot point has a head portion that fits snugly into the recess or aperture of the full circle disc wheel.

BRIEF DESCRIPTION OF THE DRAWING FIGURES

The operation, nuances of the design and features of the invention will be realized through a perusal of the drawing figures in conjunction with the reading of the following discription wherein.

DETAILED DESCRIPTION OF THE INVENTION

Like figures represent like elements in each of the figures. One of the main advantages of this invention is that it alleviates uncertainties when attempting to determine angles and miters for installation of trim and molding to be fastened to walls.

Figure 1:
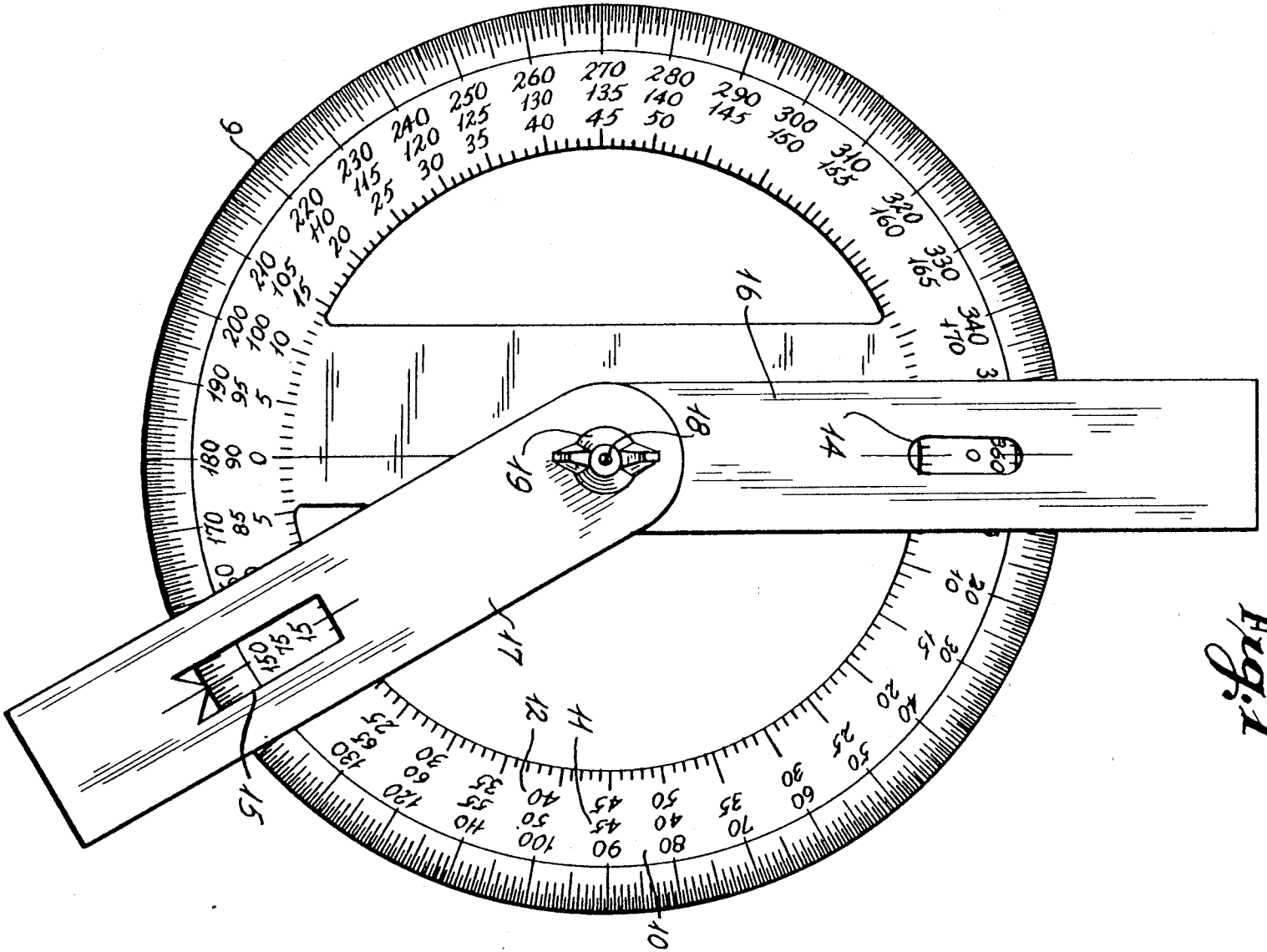
FIG. 1 is a full size view of the circular protractor containing three separate scales and an adjustable leg assembly with apertures to enable reading of the scales.

FIG. 1 the measuring means generally 9 contain three scales having graduations of measure. The outer scale 10 is the full angle measure, the intermediate scale 11 is the bisected or miter angle measure and the inner scale 12 is the setting to be used in conjunction with the scale on a miter saw. At the exact center point of the measuring means is a circular pilot opening 13 to accommodate the cylindrical pilot portion of the threaded means 18.

The adjustable leg assembly 16 and 17 in FIG. 1 contains an oval aperture 14 to be placed at zero degrees by the user when the adjustable leg assembly is placed on the measuring means 9 with the pilot portion in the circular pilot opening 13 and an angle reading aperture with an inwardly directed pointer 15. The oval aperature 14, with scribe lines extending from the rounded ends therefrom as shown in FIG. 1, or alternatively the angle reading aperture with adjacent scribe lines as well as an inwardly directed pointer, again as shown in FIG. 1, serve as "indexing means" such that alignment of scribe lines of either style of indexing means with a scale on the measuring means will allow a figure to be accurately read from one of, or several of the scales. As can be seen in FIG. 1 the oval aperture 14 or indexing means has been placed so that its scribe lines align with the 0 degree and 360 degree measurements on the scale. The scribe lines of the second indexing means are aligned with the 15, 75 and 150 degree measurements.

Figure 2:
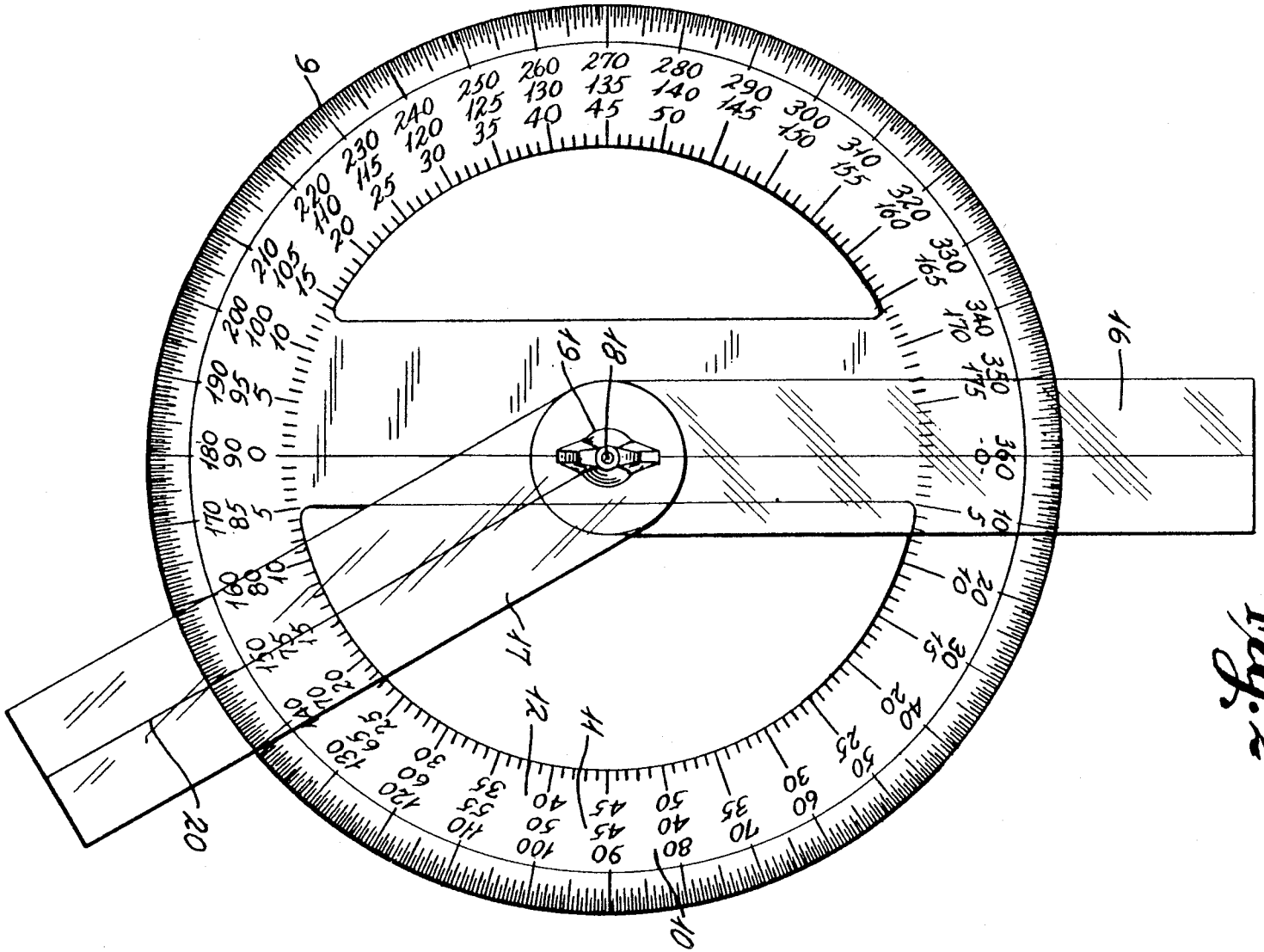
FIG. 2 is a full size view of the device shown in FIG. 1 with a transparent leg assembly employing center lines to determine the precise scale reading.
Figure 3:
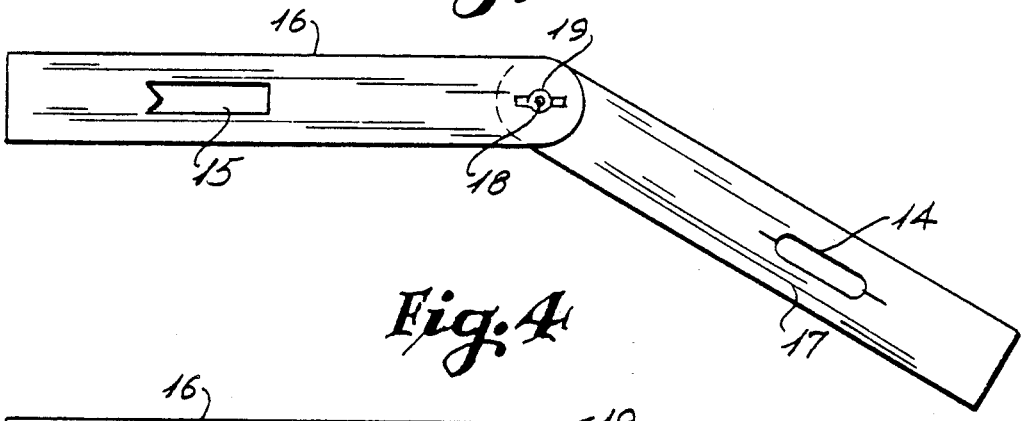
FIG. 3 shows the detachable adjustable leg assembly with viewing apertures.
Figure 4:
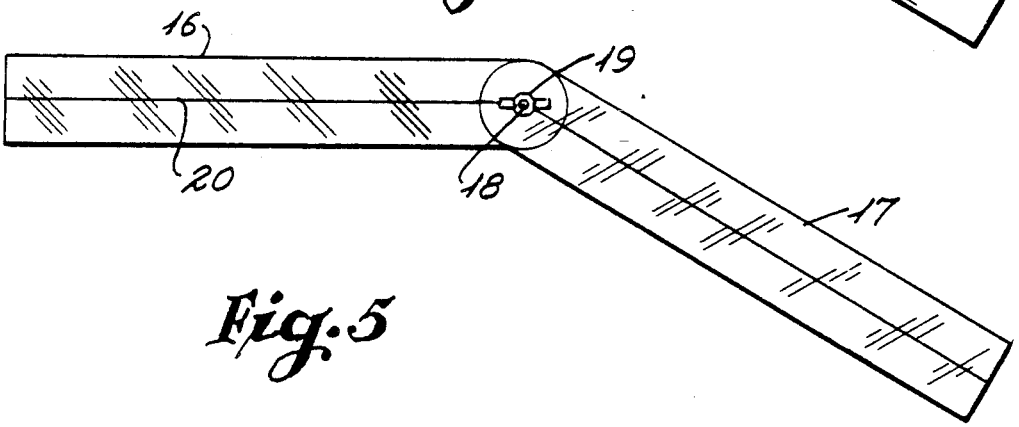
FIG. 4 shows the detachable transparent adjustable leg assembly.

An alternative embodiment of the adjustable leg assembly in FIG. 2 employs a center line 20 on each leg to be used in the same manner as the scribe lines of the indexing means on the angle reading apertures of the preferred embodiment.

Figure 5:
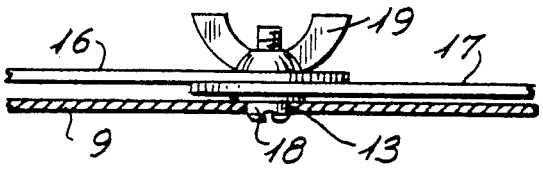
FIG. 5 is the friction inducing means.

FIG. 5 details the friction inducing means of the adjustable leg assembly. A clamping pressure dispersing means 21, a wing nut means 19 and a threaded portion with a cylindrical pilot head 18 is shown. The measuring means 9 has been sectioned to show the interface of the cylindrical pilot head 18 with the circular pilot opening 13 formed in the measuring means.

Figure 6:
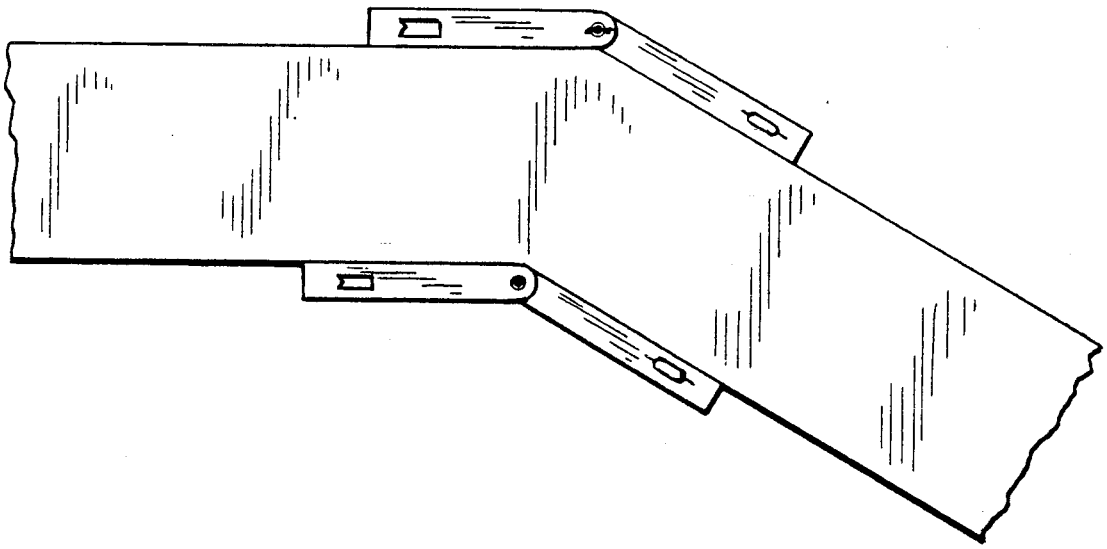
FIG. 6 illustrates the ease of measuring inside or outside obtuse angles.

In FIG. 6 the adjustable leg assembly is depicted as it would be positioned on an "outside" corner, the upper presentation, and on an "inside" corner as shown in the lower presentation. The adjustable leg assembly 16 and 17 has been laid up next to the wall surfaces to measure the intersection angle between the walls. The adjustable leg assembly is tightened by means of the wing nut and then positioned on the full circle protractor with the cylindrical pilot portion 18 placed in the circular pilot opening 13. The pilot portion 18 serves as a "locating means" when cooperatively placed in the circular pilot opening 13. The adjustable leg assembly is then aligned with the indexing means of one leg, that would be, for example, the oval aperture 14 and its scribe lines, on the zero degree mark and reading the degree mark of one or more than one of the scales from the position of the other index means, for instance the inwardly directed pointer style indexing means 15, of the remaining leg.

As can be realized by an astute reader of the above specification the invention provides a new and useful device for measuring angles and directly reading miter saw setup values. The invention presented herein and various nuances of design that a person or ordinary skill in the art may contemplate are to be covered by the following claims wherein:

I claim:

1. A measuring means for allowing the precise measurement of angles comprising:

a base including means defining at least a segment of a circle having a radius and defining a center point of said segment of the circle, at least one scale extending along said segment defining the angle of measure around said segment, a pair of adjustable legs attached at one end thereof defining a pivot point and a locating means for removably locating said legs on said base, said locating means comprised of a pilot opening at said center point on said base and a pilot head, sized to substantially match said pilot opening, attached to said adjustable legs at said pivot point thereof and indexing means provided on each of said adjustable legs at a location so that said indexing means will align with said at least one scale when said pilot head is placed into said pilot opening.

2. The invention in accordance with claim 1 wherein said at least one scale include a full angle meansure in degrees, a bisected angle measure in degrees, and a scale reading in increments used on scales of power miter saws.

3. The invention in accordance with claim 1 wherein said indexing means include apertures in said adjustable legs.

4. A measuring means for allowing the precise measurement of internal and external acute and obtuse angles comprising:

a full circle disc having at least one scale scribed thereon including a full angle measure in degrees, a bisected angle in degrees and a scale reading in increments used on scales of power miter saws;

a pair of adjustable legs, attached at one end thereof defining a pivot point, having a locating means for locating said legs on said full circle disc including a circular pilot opening having a diameter defined by said full circle disc, said pilot opening being located at the center of said full circle disc and a cylindrical pilot head having a diameter substantially equal to said diameter of said circular pilot opening attached to said adjustable legs at the pivot point thereof and said adjustable legs, each provided with indexing means, whereby said indexing means of said legs will align with incremental scribe marks of said scales on said full circle disc when said cylindrical pilot head is placed into said circular pilot opening.

5. The invention in accordance with claim 4 wherein said indexing means include an aperture in each of said adjustable legs and scribe marks emanating from said aperture onto a respective one of said legs.

* * * * *